United States Patent [19]

Gherling

[11] Patent Number: 4,833,750

[45] Date of Patent: May 30, 1989

[54] RAMP SECTION FOR COLLAPSIBLE FLOATING BRIDGE OR FERRY

[75] Inventor: Jan Gherling, Gustavsburg, Fed. Rep. of Germany

[73] Assignee: Man Gutehoffnungshuette, Fed. Rep. of Germany

[21] Appl. No.: 244,922

[22] Filed: Sep. 15, 1988

[30] Foreign Application Priority Data

Sep. 24, 1987 [DE] Fed. Rep. of Germany ..... 3732130

[51] Int. Cl.[4] ..... E01D 15/08

[52] U.S. Cl. ..... 14/27; 14/69.5

[58] Field of Search ..... 14/27, 2.6, 1, 69.5; 114/264, 266, 267

[56] References Cited

U.S. PATENT DOCUMENTS

| | | | |
|---|---|---|---|
| 4,223,623 | 9/1980 | Brunet | 14/27 |
| 4,386,441 | 6/1983 | Lundholm | 14/27 |
| 4,493,284 | 1/1985 | Echtler | 14/27 |
| 4,730,574 | 3/1988 | Diefendahl | 14/27 |

FOREIGN PATENT DOCUMENTS 3045472 12/1982 Fed. Rep. of Germany .

*Primary Examiner*—Jerome W. Massie, IV
*Assistant Examiner*—Gay Ann Spahn
*Attorney, Agent, or Firm*—McGlew & Tuttle

[57] ABSTRACT

The invention relates to a ramp section or assembly for a collapsible floating bridge or ferry. The ramp section comprises two inner and two part outer float elements, connected together by joints. The two parts of the float element are, according to the invention, composed of a pair of partial constant and partial transversely convering cross section and a pair movable relative to the part of partial constant and partial transversely converging cross section, which are pivotably connected by first joints. Through the first joint the movable part can be brought into aligned arrangement or juxtaposition with the part of constant cross section when picking up from or setting down on a transport vehicle, so that guiding by the rollers connected with the transport vehicle is achieved.

5 Claims, 4 Drawing Sheets

5
7
2a
3
6
8
1a
12
1b
2b
12

RAMP SECTION FOR COLLAPSIBLE FLOATING BRIDGE OR FERRY

BACKGROUND OF THE INVENTION

Field of the Invention

The invention relates, in general, to water vessels and, in particular to a ramp section for a collapsible floating bridge or ferry, comparing two inner single part and two outer two part, float elements, the inner float elements being connected by joints to pivot about a longitudinal center axis and each outer float element being connected with an outer side of an inner float element.

Through German Pat. No. 30 45 472, equipping floating bridges or ferries with a foldable or collapsible ramp section is known. A ramp section of this kind consists of inner float elements which are foldable about their longitudinal center axis by means of joints. The outer float elements are fastened to the inner float elements by bolts. A disadvantage of this ramp section is to be seen in that the joints between the inner float elements rest on the ground on the shore side, so that for moored ramps they must have sand bags or squared timber placed under them to be protected from damage by resting on the firmed ground.

SUMMARY OF THE INVENTION

As differentiated therefrom, the invention avoids such joints in the shore region of the inner float elements, without at the same time losing the transportability of a folded ramp section on the usual transport vehicles provided with at least two roller pairs.

According to the invention, each outer float element includes a fixed part of partial constant and partial transversely converging cross section and a movable part of longitudinally and transversely converging cross section. The movable part is connected with the fixed part by first joints in such a way that the axis of rotation of the first joints is perpendicular to the direction of passage, and that the fixed part of the outer float elements is connected to the inner float elements by second joints in such a way that both can execute pivot movements about an axis parallel to the direction of passage.

Due to the articulated connection of the two parts of the outer float elements, the edges thereof can, in the folded state, be brought into an aligned direction, so that on transport vehicles the usual rollers can be used for setting down and picking up the ramp sections.

An advantageous development of the invention is to be seen in that the joints between the inner float elements are arranged only in a region of constant cross section.

Due to the arrangement of the joints outside the region in which the inner float elements rest on the shore, underlaying before travel is not necessary, as contact of the joints on firmed shoreland need not occur.

The various features of novelty which characterize the invention are pointed out with particularity in the claims annexed to and forming a part of this disclosure. For a better understanding of the invention, its operating advantages and specific objects obtained by its uses, reference is made to the accompanying drawings and descriptive matter in which a preferred embodiment of the invention is illustrated.

GENERAL DESCRIPTION OF THE PREFERRED EMBODIMENT

Figure 1:
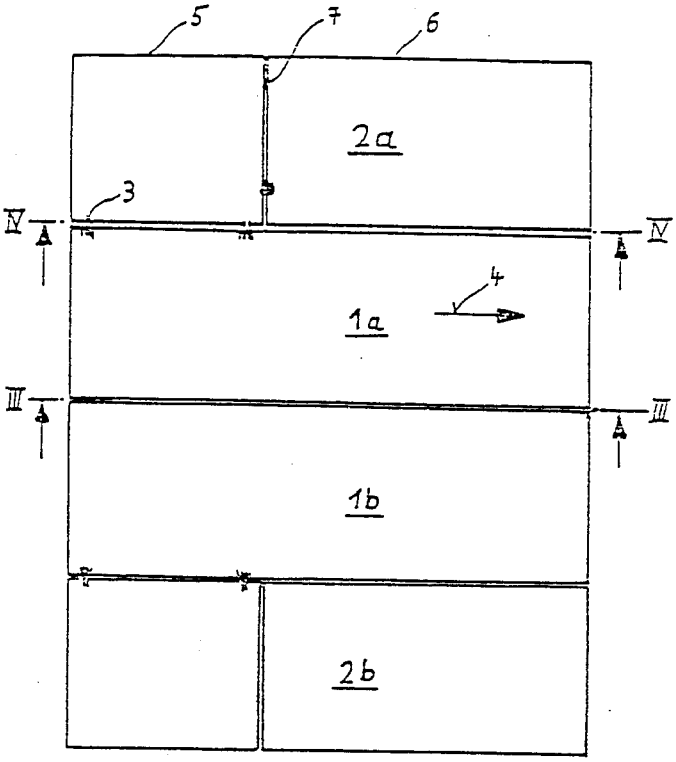
FIG. 1 is a top plan view onto a ramp section constructed in accordance with the invention.
Figure 4:
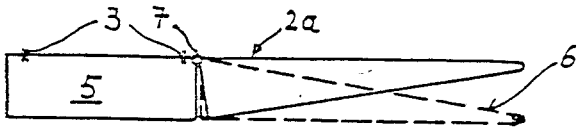
FIG. 4 is a side view of an outer float element taken along the section VI—VI of FIG. 1.

For vehicles to drive onto and off floating bridges, collapsible ramp sections are needed at the transition to the shore region. A floatable ramp assembly is illustrated in FIG. 1 in top view. The ramp assembly comprises two inner float elements 1*a* and 1*b*, which are foldable about their longitudinal center axis or first joint 8. To each of the inner float element 1*a* and 1*b*, a two part, outer float element 2*a* and 2*b* is connected through second joints 3. The direction of passage is indicated by an arrow 4. The outer float elements 2*a* and 2*b* are made in two parts. For reasons of symmetry only the outer float element 2*a* will be described, which comprises a part 5 of partial constant and partial transversely converging cross section and a part 6 of longitudinally and transversely converging cross section (FIG. 4). Both parts 5 and 6 pivot about an axis perpendicular to the passage direction 4 through first joints 7.

Figure 2:
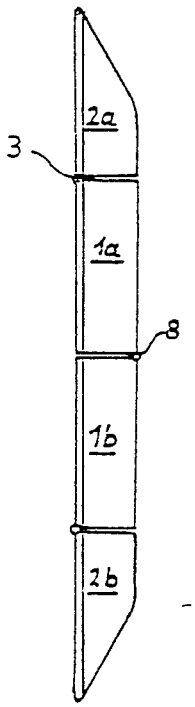
FIG. 2 is a front elevational view of the ramp section.

FIG. 2 shows a front view of the ramp section in the unfolded state in float position. The two inner float elements 1*a* and 1*b* are pivotably connected by joints 8. The second joints 3 connect the inner float element 1*a* with the part of partial constant and partial transversely convering cross section, part 5 (FIG. 1) of the outer float element 2*a*.

Figure 3:
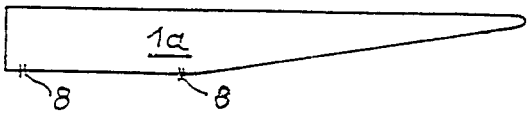
FIG. 3 is a side view of an inner float element of the ramp section taken along the section III—III of FIG. 1.

A side view (section III—III) of the inner float element 1*a* is shown in FIG. 3. Both joints 8 are arranged in the region of constant cross section. The longitudinally converging part is turned toward the shore region. By the position of the joints 8 it is ensured that when being traveled over they will not set down on a shore fortification.

FIG. 4 shows a side view (section IV—IV) of the outer float element 2*a*. According to the invention, it comprises a fixed part 5 of partial constant and partial transversely converging cross section and a movable part 6 of longitudinally and transversely converging cross section. Both parts 5 and 6 are pivotable about an axis perpendicular to the passage direction 4 (FIG. 1) through first joints 7. The fixed part 6 of the outer float element 2*a* is pivotably connected with the inner float element 1*a* by the second joints 3.

Figure 5:
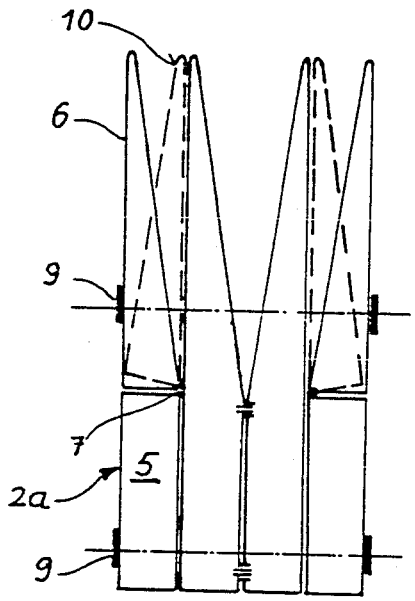
FIG. 5 is a top view of the ramp section in a folded condition.

The function of the first joints 7 is evident from the top view onto the folded ramp section in FIG. 5. Part 6, relative to part 5, of the outer float element 2*a* is pivotably connected with the fixed part through first joints 7.

A transport vehicle not shown in detail is provided with rollers 9, which are arranged in alignment. If part 6 which is movable relative to part 5, were connected rigidly with the part 5 in the position 10 shown in broken lines, as best suitable for driving vehicles on or off, this would, of course, not ensure guidance on the rollers 9 of the transport vehicle and it would be necessary to provide complicated guide mechanisms. By the first joint 7 the movable part 6 is brought into aligned arrangement to part 5, so that guidance is possible with the usual rollers 9 of the transport vehicles.

Figure 6:
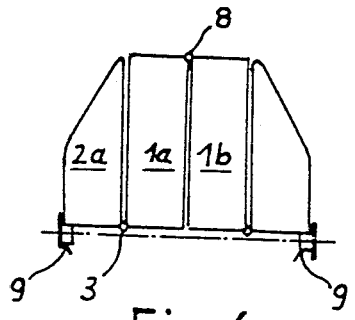
FIG. 6 is a view of the folded ramp section with rollers of a transport vehicle.

In FIG. 6, the ramp section is shown in front view in the direction of the longitudinal axis of a transport vehicle. The inner float elements 1*a* and 1*b* are pivotable by joints 8. For reasons of symmetry only 2*a* of the outer two part float element is designated, which is articulated to the inner float element 1*a* through second joints 3 at the bottom. Guiding of the ramp section on the transport vehicle is done by the rollers 9.

Figure 7:
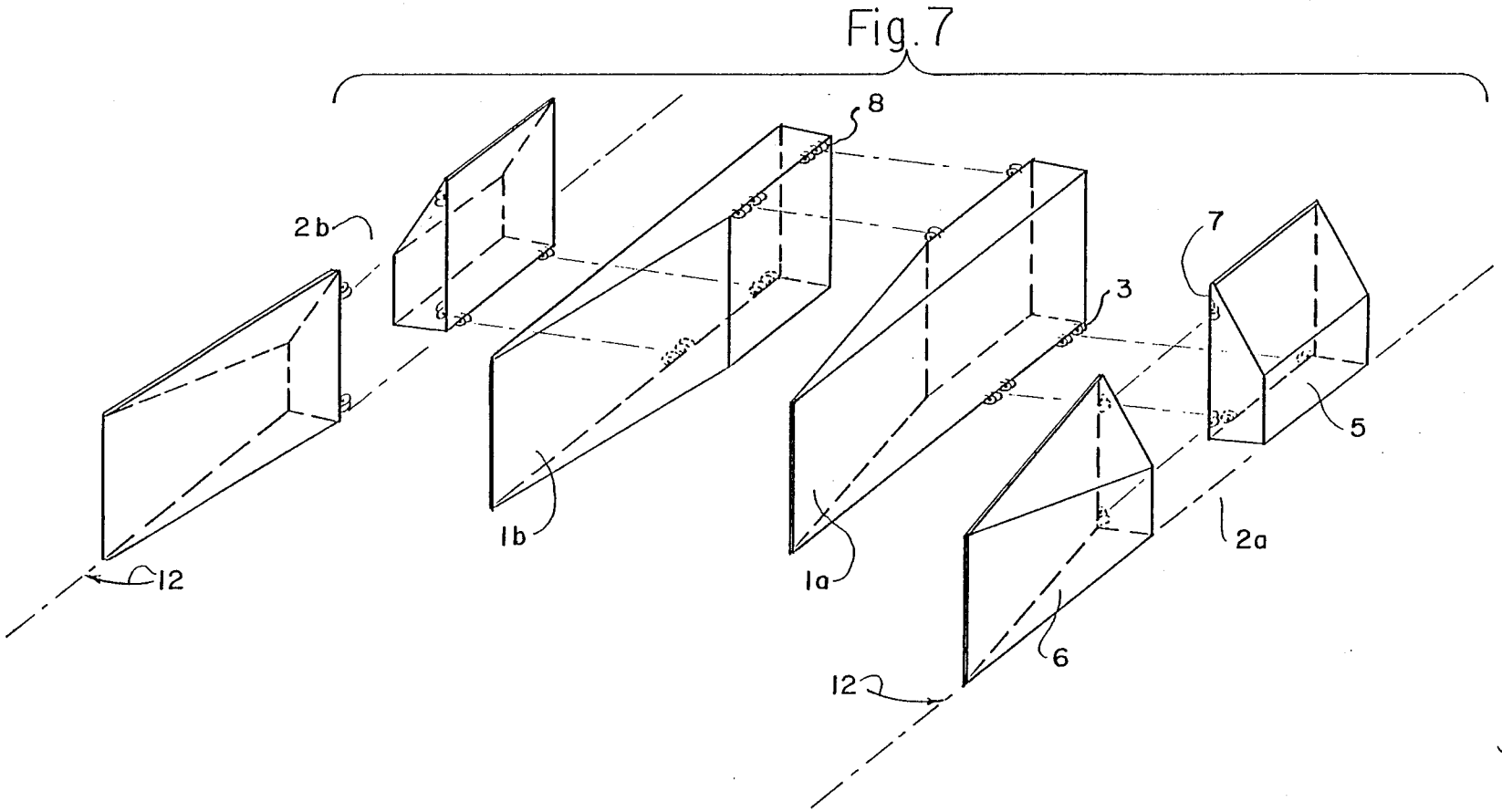
FIG. 7 is an exploded perspective view of the ramp section in a folded condition.
Figure 8:
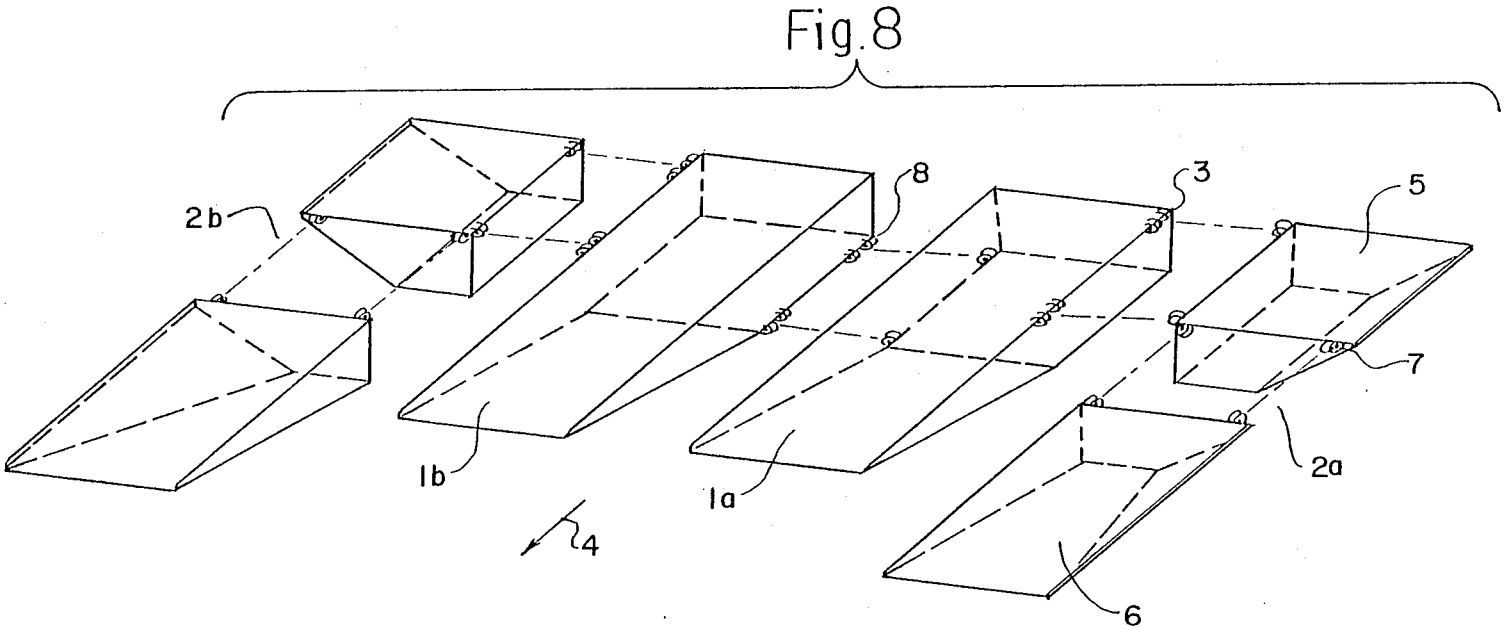
FIG. 8 is an exploded perspective view of the ramp section in an unfolded condition.

In FIGS. 7 and 8, the ramp section is shown in exploded views, in a folded condition, and an unfolded condition respectively. FIG. 7 shows swerve arrows 12 which indicate the direction the movable part 6 is pivotably movable relative to part 5.

While a specific embodiment of the invention has been shown and described in detail to illustrate the application of the principles of the invention, it will be understood that the invention may be embodied otherwise without departing from such principles.

What is claimed is:

1. A ramp section for a collapsible floating bridge and ferry, comprising two inner and two two-part outer float elements, said inner float elements being connected by pivot joints permitting pivoting of said two inner float elements relative to each other about a longitudinal axis, said inner float elements each having an outer side, each outer float element being pivotally connected with a respective outer side of a respective other of said inner float elements, each outer float element comprising a first part and a second part which is movable relative to said first part and of a longitudinally converging cross section, said second part being connected with said first part by first pivot joints in such a way that the axis of rotation of said first pivot joints is perpendicular to a direction of passage and said first part of the outer float elements being connected to said inner float elements by second joints in such a way that both of said first and second outer float elements can execute pivot movements about an axis parallel to the direction of passage.

2. A ramp section according to claim 1, wherein said pivot joints between said two inner float elements are arranged in a region of constant cross section of said inner float elements.

3. A ramp section according to claim 1, including a roller connected to an outer edge of each of said outer float elements.

4. A ramp section according to claim 1, wherein said inner float elements have a portion of constant cross section immediately adjacent to a portion of longitudinally converging cross section.

5. A ramp section according to claim 1, comprising a top deck level and a bottom deck level wherein said pivot joints between said first part and said second part are arranged at selected level, between and including said top deck level and said bottom deck level.

* * * * *